US009470998B2

(12) United States Patent
Suzuki

(10) Patent No.: US 9,470,998 B2
(45) Date of Patent: Oct. 18, 2016

(54) ELECTROCONDUCTIVE ROLLER, AND IMAGE FORMING APPARATUS

(71) Applicant: SUMITOMO RUBBER INDUSTRIES, LTD., Kobe-shi, Hyogo (JP)

(72) Inventor: Daijiro Suzuki, Kobe (JP)

(73) Assignee: SUMITOMO RUBBER INDUSTRIES, LTD., Kobe-Shi (KR)

( * ) Notice: Subject to any disclaimer, the term of this patent is extended or adjusted under 35 U.S.C. 154(b) by 0 days.

(21) Appl. No.: 14/820,941

(22) Filed: Aug. 7, 2015

(65) Prior Publication Data

US 2016/0041491 A1 Feb. 11, 2016

(30) Foreign Application Priority Data

Aug. 8, 2014 (JP) ..... 2014-162999

(51) Int. Cl.
*G03G 15/02* (2006.01)

(52) U.S. Cl.
CPC ..... *G03G 15/0233* (2013.01)

(58) Field of Classification Search
CPC ..... G03G 15/0233
See application file for complete search history.

(56) References Cited

U.S. PATENT DOCUMENTS 5,604,031 A * 2/1997 Yamamoto ..... G03G 15/0233 428/335
2008/0247778 A1* 10/2008 Motokawa ..... C08G 18/10 399/159
2010/0142998 A1 6/2010 Furukawa et al.

FOREIGN PATENT DOCUMENTS

JP 5063663 B2 10/2012
JP 2013-97117 A 5/2013

* cited by examiner

*Primary Examiner* — G. M. Hyder
(74) *Attorney, Agent, or Firm* — Birch, Stewart, Kolasch & Birch, LLP

(57) ABSTRACT

An electroconductive roller is provided, which is imparted with lower resistance than a prior-art electroconductive roller without addition of an expensive salt and an electron conductive agent liable to cause various problems or by adding the electron conductive agent in a smaller proportion that hardly causes the problems, and an image forming apparatus employing the electroconductive roller is also provided. The electroconductive roller (1) includes a tubular base layer (4) made of an ion-conductive elastic material, and a surface layer (6) provided on an outer peripheral surface (5) of the base layer (4). The roller resistance $R_1$ (Ω) of the base layer and the surface resistance $R_2$ (Ω) of an outer peripheral surface (7) of the surface layer satisfy all the following expressions (1) to (3):

$$\log R_1 - \log R_2 \geq 2.5 \quad (1)$$

$$\log R_1 \leq 7.0 \quad (2)$$

$$\log R_2 \leq 4.0 \quad (3)$$

The image forming apparatus incorporates the electroconductive roller as a charging roller.

7 Claims, 4 Drawing Sheets

FIG. 4 ( a )
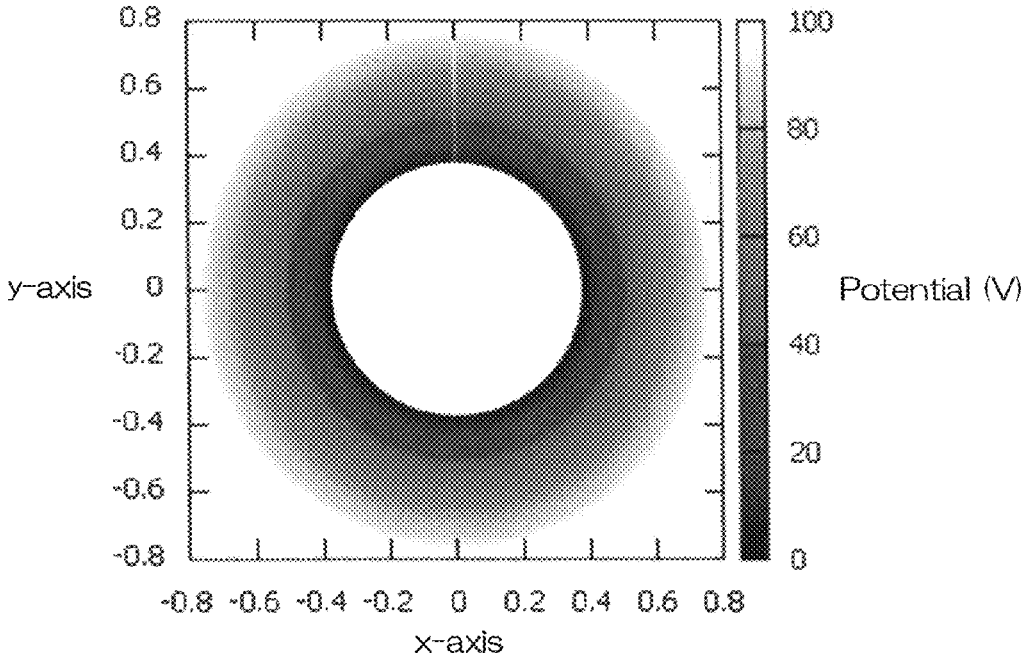
FIG. 4 ( b )
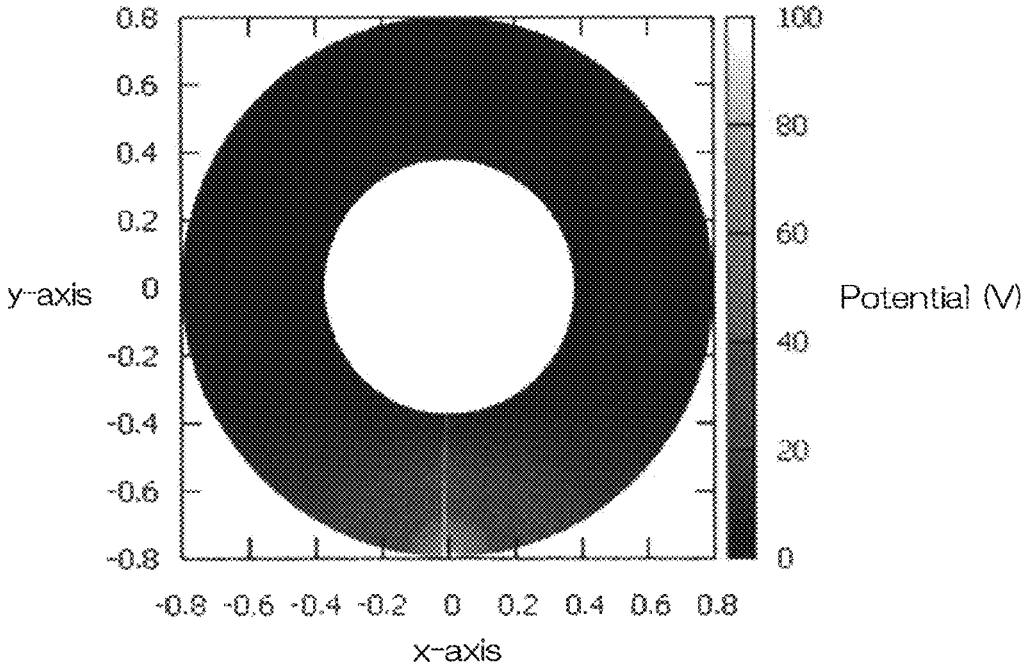

ELECTROCONDUCTIVE ROLLER, AND IMAGE FORMING APPARATUS

TECHNICAL FIELD

The present invention relates to an electroconductive roller for use as a charging roller, and to an image forming apparatus employing the electroconductive roller.

BACKGROUND ART

In an electrophotographic image forming apparatus such as a laser printer, an electrostatic copying machine, a plain paper facsimile machine or a printer-copier-facsimile multifunction machine, an image is generally formed on a surface of a sheet such as a paper sheet or a plastic film through the following process steps.

First, a surface of a photoreceptor body having photoelectric conductivity is evenly electrically charged and, in this state, exposed to light, whereby an electrostatic latent image corresponding to an image to be formed on the sheet is formed on the surface of the photoreceptor body (charging step and exposing step).

Then, toner (minute color particles) preliminarily electrically charged at a predetermined potential is brought into contact with the surface of the photoreceptor body. Thus, the toner selectively adheres to the surface of the photoreceptor body according to the potential pattern of the electrostatic latent image, whereby the electrostatic latent image is developed into a toner image (developing step).

Subsequently, the toner image is transferred onto the surface of the sheet (transfer step), and fixed to the surface of the sheet (fixing step). Thus, the image is formed on the surface of the sheet.

Further, a part of the toner remaining on the surface of the photoreceptor body after the transfer of the toner image is removed, for example by a cleaning blade or the like (cleaning step). Thus, the photoreceptor body is ready for the next image formation.

In the charging step out of the aforementioned process steps, a charging roller is used, which is kept in contact with the surface of the photoreceptor body to evenly electrically charge the surface of the photoreceptor body.

Widely used as the charging roller is an electroconductive roller having an outer peripheral surface to be kept in contact with the surface of the photoreceptor body, at least the outer peripheral surface being made of a crosslinking product of an electrically conductive rubber composition and having lower resistance.

Generally usable as the rubber composition for the electroconductive roller is a rubber composition imparted with ion conductivity by blending a rubber component including at least an ion conductive rubber (e.g., an epichlorohydrin rubber) and a diene rubber, a crosslinking component for crosslinking the rubber component, and the like.

In order to further reduce the resistance of the electroconductive roller, a slat of an anion containing a fluoro group and a sulfonyl group and a cation of a metal element, or an ionic liquid is often blended in the rubber composition (Patent Document land the like), or electrically conductive carbon is blended in the rubber composition.

CITATION LIST

Patent Document

Patent Document 1: JP2013-97117A
Patent Document 2: JP5063663

SUMMARY OF THE INVENTION

Problem to be Solved by the Invention

If the resistance of the overall electroconductive roller is reduced by blending the salt of the cation and the anion in the rubber composition, however, a great amount of the salt is required. This may result in cost increase of the electroconductive roller because the salt is expensive. In addition, the reduction of the resistance by the blending of a great amount of the salt has limitation (about $10^{4.8}\Omega$), and further reduction of the resistance is difficult.

Where an electron conductive agent such as electrically conductive carbon is blended in the rubber composition, the resistance of the electroconductive roller can be further reduced to less than the limitation. In this case, however, the voltage dependence of the roller resistance of the electroconductive roller is increased, making it difficult to handle the electroconductive roller. Further, the resistance of the electroconductive roller is steeply reduced by the addition of the electrically conductive carbon. Therefore, it is difficult to control the resistance of the electroconductive roller to a desired level. In addition, the electroconductive roller produced by blending the electrically conductive carbon has a higher hardness and, when being used as the charging roller, for example, cannot easily follow the surface unevenness of the photoreceptor body, failing to evenly electrically charge the photoreceptor body. This may result in uneven charging.

Patent Document 2 proposes that a surface layer containing graphite or carbon dispersion is formed on the outer peripheral surface of the electroconductive roller in order to stably electrically charge the photo receptor body for prevention of fogging of a formed image. However, it is difficult to further reduce the resistance of the electroconductive roller with the provision of the surface layer of the conventional structure.

It is an object of the present invention to provide an electroconductive roller which is imparted with lower resistance than the prior-art electroconductive roller without the addition of the expensive salt and the electron conductive agent liable to cause various problems or by adding the electron conductive agent in a smaller proportion that hardly causes the aforementioned problems, and to provide an image forming apparatus employing the electroconductive roller.

Solution to Problem

The present invention provides an electroconductive roller, which includes a tubular base layer made of an ion-conductive elastic material, and a surface layer provided on an outer peripheral surface of the base layer, wherein the roller resistance $R_1$ ($\Omega$) of the base layer and the surface resistance $R_2$ ($\Omega$) of an outer peripheral surface of the surface layer satisfy all the following expressions (1) to (3):

$$\log R_1 - \log R_2 \geq 2.5 \quad (1)$$

$$\log R_1 \leq 7.0 \quad (2)$$

$$\log R_2 \leq 4.0 \quad (3)$$

The present invention also provides an image forming apparatus which incorporates the inventive electroconductive roller as a charging roller.

Effects of the Invention

According to the present invention, the electroconductive roller is configured such that the surface layer is provided on the outer peripheral surface of the flexible base layer, and the resistances of the base layer and the surface layer satisfy all the above expressions (1) to (3). Thus, the electroconductive roller is imparted with lower resistance than the prior-art electroconductive roller without the addition of the expensive salt and the electron conductive agent liable to cause various problems or by adding the electron conductive agent in a smaller proportion that hardly causes the aforementioned problems. The image forming apparatus employing the electroconductive roller is also provided.

BRIEF DESCRIPTION OF THE DRAWINGS

FIGS. 4(*a*) and 4(*b*) are graphs showing the simulation results of the potential distributions according to an inventive example and a comparative example, respectively.

EMBODIMENTS OF THE INVENTION

Figure 1:
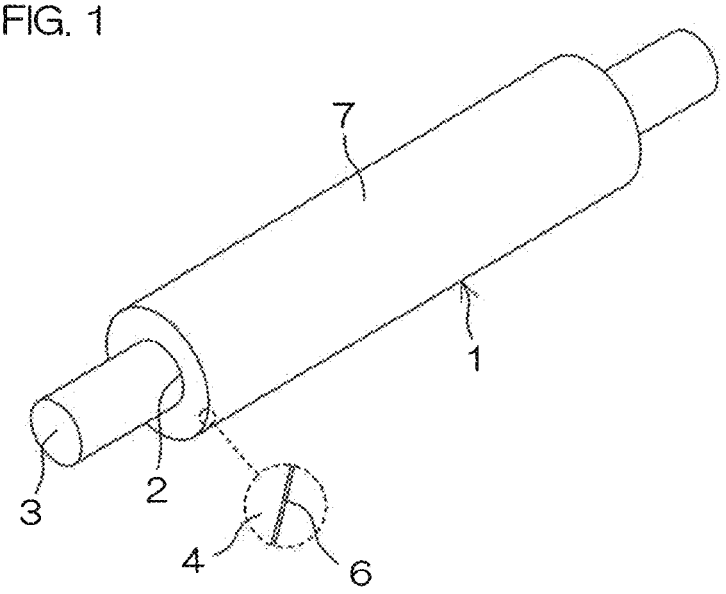
FIG. 1 is a perspective view illustrating an exemplary electroconductive roller according to the present invention.
Figure 2A:
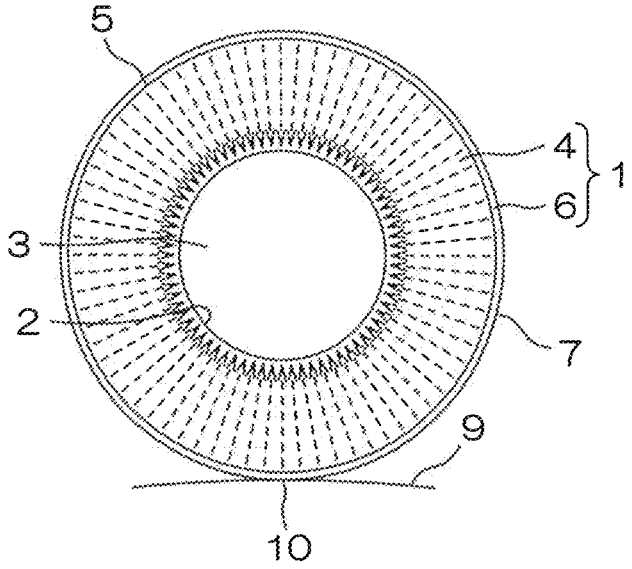
FIGS. 2(*a*) and 2(*b*) are diagrams for explaining a mechanism of reducing the resistance of the electroconductive roller to a lower level than the prior art by the arrangement of the present invention.
Figure 2B:
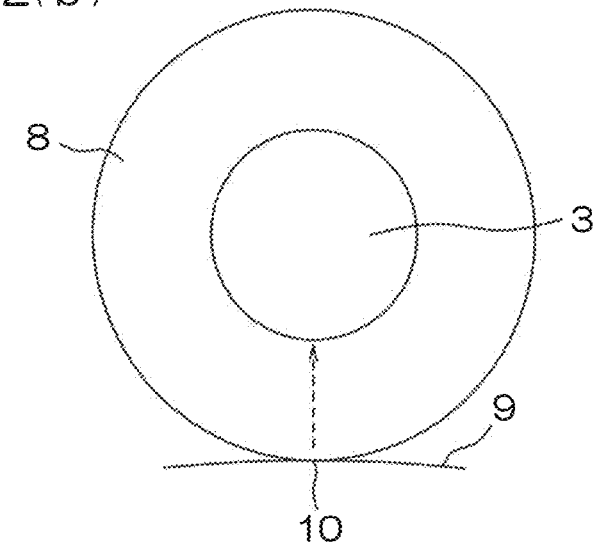

Referring to FIGS. 1 and 2(*a*), an electroconductive roller 1 according to one embodiment of the present invention includes a tubular base layer 4 made of an ion-conductive elastic material and having a center through-hole 2, a surface layer 6 provided on an outer peripheral surface 5 of the base layer 4, and a shaft 3 inserted through and fixed to the through-hole 2.

The shaft 3 is a unitary member made of a metal such as aluminum, an aluminum alloy or a stainless steel.

The shaft 3 is electrically connected to and mechanically fixed to the base layer 4, for example, via an electrically conductive adhesive agent. Alternatively, a shaft having an outer diameter that is greater than the inner diameter of the through-hole 2 is used as the shaft 3, and press-inserted into the through-hole 2 to be electrically connected to and mechanically fixed to the base layer 4. Thus, the shaft 3 and the base layer 4 are unitarily rotatable.

In the present invention, the roller resistance $R_1$ (Ω) of the base layer 4 and the surface resistance $R_2$ (Ω) of an outer peripheral surface 7 of the surface layer 6 should satisfy all the following expressions (1) to (3):

$$\log R_1 - \log R_2 \geq 2.5 \quad (1)$$

$$\log R_1 \leq 7.0 \quad (2)$$

$$\log R_2 \leq 4.0 \quad (3)$$

In general, the electrical resistance is proportional to the volume resistivity and the length of a path along which electric current flows, and inversely proportional to the sectional area of the path.

In the case of an ordinary electroconductive roller 8 having no surface layer as shown in FIG. 2(*b*) for use as a charging roller, for example, the path of the electric current flowing through the electroconductive roller 8 is the shortest linear region (indicated by a broken line in FIG. 2(*b*)) through which a contact 10 with the photoreceptor body 9 is connected to a shaft 3 inserted through the electroconductive roller 8 as seen in the section of the electroconductive roller 8 and, hence, has a very small sectional area. Therefore, the reduction of the resistance has limitation, even if an attempt is made to reduce the volume resistivity by adjusting the composition of the material for the electroconductive roller.

In the inventive electroconductive roller 1 configured such that the surface layer 6 is provided on the outer peripheral surface 5 of the flexible base layer 4 as shown in FIGS. 1 and 2(*a*) and the resistances of the surface layer 6 and the base layer 4 satisfy all the above expressions (1) to (3), on the other hand, the surface layer 6 serves as an electrical conductor directly connected to the contact 10 with the photoreceptor body 9. Therefore, as shown by broken lines in FIG. 2(*a*), the entire circumferential base layer 4 functions as the electric current path extending to the shaft 3 and, hence, the path has a significantly increased sectional area.

Therefore, the volume resistivity of the base layer 4 is significantly reduced to a lower level than the prior art without the addition of the expensive salt and the electron conductive agent liable to cause various problems (in the absence of the salt and the electron conductive agent) or by adding the electron conductive agent in a smaller proportion that hardly causes the aforementioned problems. Thus, the resistance of the electroconductive roller 1 can be further reduced to a lower level than the prior art.

More specifically, the roller resistance $R_3$ (Ω) of the overall electroconductive roller 1 including the base layer 4 and the surface layer 6 provided on the base layer 4 can satisfy the following expression (4):

$$\log R_3 \leq 4.7 \quad (4)$$

That is, the roller resistance of the electroconductive roller 1 can be reduced to a level of not higher than $10^{4.7}$Ω that is unachievable by the prior art.

The roller resistance $R_3$ (Ω) can be controlled at any intended level principally by properly selecting an ion-conductive elastic material for the base layer 4. Even if the electron conductive agent is blended in a material for the surface layer 6 in order to satisfy all the expressions (1) to (3), therefore, it is possible to easily control the roller resistance $R_3$ (Ω) while reducing the voltage dependence of the roller resistance.

In addition, the surface layer 6 can be formed as having a significantly smaller thickness than the base layer 4. Where the electroconductive roller 1 is used as the charging roller, therefore, the electroconductive roller 1 can follow the surface unevenness of the photoreceptor body 9 to evenly electrically charge the photoreceptor body 9. Thus, the uneven charging can be suppressed.

In the present invention, the resistances of the base layer 4 and the surface layer 6 should satisfy all the expressions (1) to (3) for the following reasons. If at least one of the expressions is not satisfied, the roller resistance $R_3$ (Ω) of the overall electroconductive roller 1 cannot be sufficiently reduced due to the mechanism described above.

The difference $\log R_1 - \log R_2$ defined by the expression (1) is preferably not greater than 5.5 in the aforementioned range.

In order to increase the difference $\log R_1 - \log R_2$ to greater than 5.5, it is necessary to increase the roller resistance $R_1$ (Ω) of the base layer 4, or to reduce the surface resistance $R_2$ (Ω) of the outer peripheral surface 7 of the surface layer 6.

In the former case, however, the roller resistance $R_1$ (Ω) of the base layer 4 is liable to fall outside the range of log $R_1 \leq 7.0$ defined by the expression (2), making it impossible to reduce the roller resistance $R_3$ (Ω) of the overall electroconductive roller 1.

Even if the electron conductive agent such as the electrically conductive carbon is blended, the reduction of the surface resistance $R_2$ (Ω) of the outer peripheral surface 7 of the surface layer 6 has limitation, making it substantially difficult to reduce the surface resistance $R_2$ (Ω) as in the latter case to increase the difference $\log R_1 - \log R_2$ to greater than 5.5.

The roller resistance $R_1$ (Ω) of the base layer 4 defined by the expression (2) is preferably $5.5 \log R_1 \leq 7.0$.

If $\log R_1$ is less than this range, it is necessary to reduce the surface resistance $R_2$ (Ω) of the outer peripheral surface 7 of the surface layer 6 in order to maintain the resistance difference $\log R_1 - \log R_2$ at not less than 2.5. However, the reduction of the surface resistance $R_2$ (Ω) has limitation, as described above, making it substantially difficult to reduce $\log R_1$ to less than 5.5 while maintaining the difference $\log R_1 - \log R_2$ at not less than 2.5.

In order to further reduce the roller resistance $R_3$ (Ω) of the overall electroconductive roller 1, $\log R_1$ is particularly preferably $\log R_1 \leq 6.0$ in the aforementioned range of $\log R_1 \leq 7.0$.

The surface resistance $R_2$ (Ω) of the outer peripheral surface 7 of the surface layer 6 defined by the expression (3) is preferably $1.0 \leq \log R_2 \leq 4.0$.

It is substantially difficult to reduce $\log R_2$ to less than this range.

<<Base Layer 4>>

The base layer 4 of the inventive electroconductive roller 1 may be made of any of various ion-conductive elastic materials.

Particularly, the base layer 4 is preferably formed from an ion conductive rubber composition which contains a rubber component including an epichlorohydrin rubber and a diene rubber.

<Epichlorohydrin Rubber>

Examples of the epichlorohydrin rubber for the rubber component include epichlorohydrin homopolymers, epichlorohydrin-ethylene oxide bipolymers (ECO), epichlorohydrin-propylene oxide bipolymers, epichlorohydrin-allyl glycidyl ether bipolymers, epichlorohydrin-ethylene oxide-allyl glycidyl ether terpolymers (GECO), epichlorohydrin-propylene oxide-allyl glycidyl ether terpolymers and epichlorohydrin-ethylene oxide-propylene oxide-allyl glycidyl ether quaterpolymers, which may be used either alone or in combination.

Of these epichlorohydrin rubbers, the ethylene oxide-containing copolymers, particularly the ECO and/or the GECO are preferred.

These copolymers preferably each have an ethylene oxide content of not less than 30 mol % and not greater than 80 mol %, particularly preferably not less than 50 mol %.

Ethylene oxide functions to reduce the roller resistance $R_1$ (Ω) of the base layer 4.

If the ethylene oxide content is less than the aforementioned range, however, it will be impossible to sufficiently reduce the roller resistance $R_1$ (Ω).

If the ethylene oxide content is greater than the aforementioned range, on the other hand, ethylene oxide is liable to be crystallized, whereby the segment motion of molecular chains is hindered to adversely increase the roller resistance $R_1$ (Ω). Further, the base layer 4 is liable to have a higher hardness after the crosslinking, and the rubber composition is liable to have a higher viscosity when being heat-melted before the crosslinking.

The ECO has an epichlorohydrin content that is a balance obtained by subtracting the ethylene oxide content from the total. That is, the epichlorohydrin content is preferably not less than 20 mol % and not greater than 70 mol %, particularly preferably not greater than 50 mol %.

The GECO preferably has an allyl glycidyl ether content of not less than 0.5 mol % and not greater than 10 mol %, particularly preferably not less than 2 mol % and not greater than 5 mol %.

Allyl glycidyl ether per se functions as side chains of the copolymer to provide a free volume, whereby the crystallization of ethylene oxide is suppressed to reduce the roller resistance $R_1$ (Ω) of the base layer 4.

However, if the allyl glycidyl ether content is less than the aforementioned range, it will be impossible to provide this function and hence to sufficiently reduce the roller resistance $R_1$ (Ω).

Allyl glycidyl ether also functions as crosslinking sites during the crosslinking of the GECO. Therefore, if the allyl glycidyl ether content is greater than the aforementioned range, the crosslinking density of the GECO is increased, whereby the segment motion of molecular chains is hindered. This may adversely increase the roller resistance $R_1$ (Ω).

The GECO has an epichlorohydrin content that is a balance obtained by subtracting the ethylene oxide content and the allyl glycidyl ether content from the total. That is, the epichlorohydrin content is preferably not less than 10 mol % and not greater than 69.5 mol %, particularly preferably not less than 19.5 mol % and not greater than 60 mol %.

Examples of the GECO include copolymers of the three comonomers described above in a narrow sense, as well as known modification products obtained by modifying an epichlorohydrin-ethylene oxide copolymer (ECO) with allyl glycidyl ether. In the present invention, any of these modification products may be used as the GECO.

The proportion of the epichlorohydrin rubber to be blended is preferably not less than 10 parts by mass and not greater than 80 parts by mass, particularly preferably not greater than 70 parts by mass, based on 100 parts by mass of the overall rubber component.

<Diene Rubber>

The diene rubber is at least one selected from the group consisting of a styrene butadiene rubber (SBR), a chloroprene rubber (CR), an acrylonitrile butadiene rubber (NBR) and a butadiene rubber (BR), for example.

(SBR)

Usable as the SBR are various SBRs synthesized by copolymerizing styrene and 1,3-butadiene by an emulsion polymerization method, a solution polymerization method and other various polymerization methods. The SBRs include those of an oil-extension type having flexibility controlled by addition of an extension oil, and those of a non-oil-extension type containing no extension oil. Either type of SBRs is usable.

According to the styrene content, the SBRs are classified into a higher styrene content type, an intermediate styrene content type and a lower styrene content type, and any of these types of SBRs is usable.

These SBRs may be used either alone or in combination.

(CR)

The CR is synthesized, for example, by polymerizing chloroprene by an emulsion polymerization method. The CR is classified in a sulfur modification type or a non-sulfur-modification type depending on the type of a molecular weight adjusting agent to be used for the emulsion polymerization. Either type of CRs is usable in the present invention.

The sulfur modification type CR is prepared by plasticizing a copolymer of chloroprene and sulfur (molecular weight adjusting agent) with thiuram disulfide or the like to adjust the viscosity of the copolymer to a predetermined viscosity level.

The non-sulfur-modification type CR is classified, for example, in a mercaptan modification type, a xanthogen modification type or the like.

The mercaptan modification type CR is synthesized in substantially the same manner as the sulfur modification type CR, except that an alkyl mercaptan such as n-dodecyl mercaptan, tert-dodecyl mercaptan or octyl mercaptan, for example, is used as the molecular weight adjusting agent. The xanthogen modification type CR is synthesized in substantially the same manner as the sulfur modification type CR, except that an alkyl xanthogen compound is used as the molecular weight adjusting agent.

Further, the CR is classified in a lower crystallization speed type, an intermediate crystallization speed type or a higher crystallization speed type depending on the crystallization speed.

In the present invention, any of these types of CRs may be used. Particularly, CRs of the non-sulfur-modification type and the lower crystallization speed type are preferably used either alone or in combination.

Further, a rubber of a copolymer of chloroprene and other comonomer may be used as the CR.

Examples of the other comonomer include 2,3-dichloro-1,3-butadiene, 1-chloro-1,3-butadiene, styrene, acrylonitrile, methacrylonitrile, isoprene, butadiene, acrylic acid, acrylates, methacrylic acid and methacrylates, which may be used either alone or in combination.

(NBR)

The NBR is classified in a lower acrylonitrile content type, an intermediate acrylonitrile content type, an intermediate to higher acrylonitrile content type, a higher acrylonitrile content type or a very high acrylonitrile content type depending on the acrylonitrile content. Any of these types of NBRs is usable.

The NBRs include those of an oil-extension type having flexibility controlled by addition of an extension oil, and those of a non-oil-extension type containing no extension oil. Either type of NBRs is usable.

These NBRs may be used either alone or in combination.

(BR)

Usable as the BR are various crosslinkable BRs.

Particularly, a higher cis-content BR having a cis-1,4 bond content of not less than 95% and having excellent lower-temperature characteristic properties and a lower hardness and hence a higher flexibility at a lower temperature at a lower humidity is preferred.

The BRs include those of an oil-extension type having flexibility controlled by addition of an extension oil, and those of a non-oil-extension type containing no extension oil. Either type of BRs is usable.

These BRs may be used either alone or in combination.

<Crosslinking Component>

The rubber composition further contains a crosslinking component for crosslinking the rubber component. The crosslinking component includes a crosslinking agent, an accelerating agent, an acceleration assisting agent and the like.

Examples of the crosslinking agent include a sulfur crosslinking agent, a thiourea crosslinking agent, a triazine derivative crosslinking agent, a peroxide crosslinking agent and monomers, which may be used either alone or in combination.

Examples of the sulfur crosslinking agent include sulfur such as sulfur powder and organic sulfur-containing compounds. Examples of the organic sulfur-containing compounds include tetramethylthiuram disulfide and N,N-dithiobismorpholine.

Examples of the thiourea crosslinking agent include tetramethylthiourea, trimethylthiourea, ethylene thiourea, and thioureas represented by $(C_nH_{2n+1}NH)_2C{=}S$ (wherein n is an integer of 1 to 10), which may be used either alone or in combination.

Examples of the peroxide crosslinking agent include benzoyl peroxide and the like.

The sulfur and the thiourea crosslinking agent are preferably used in combination as the crosslinking agent.

The proportion of the sulfur to be used in combination with the thiourea crosslinking agent is preferably not less than 0.2 parts by mass and not greater than 3 parts by mass, particularly preferably not less than 0.5 parts by mass and not greater than 2 parts by mass, based on 100 parts by mass of the overall rubber component.

The proportion of the thiourea crosslinking agent to be blended is preferably not less than 0.2 parts by mass and not greater than 3 parts by mass, particularly preferably not less than 0.5 parts by mass and not greater than 1 part by mass, based on 100 parts by mass of the overall rubber component.

Examples of the accelerating agent include inorganic accelerating agents such as lime, magnesia (MgO) and litharge (PbO), and organic accelerating agents, which may be used either alone or in combination.

Examples of the organic accelerating agents include: guanidine accelerating agents such as 1,3-di-o-tolylguanidine, 1,3-diphenylguanidine, 1-o-tolylbiguanide and a di-o-tolylguanidine salt of dicatechol borate; thiazole accelerating agents such as 2-mercaptobenzothiazole and di-2-benzothiazolyl disulfide; sulfenamide accelerating agents such as N-cyclohexyl-2-benzothiazylsulfenamide; thiuram accelerating agents such as tetramethylthiuram monosulfide, tetramethylthiuram disulfide, tetraethylthiuram disulfide and dipentamethylenethiuram tetrasulfide; and thiourea accelerating agents, which may be used either alone or in combination.

Different types of accelerating agents have different functions and, therefore, are preferably used in combination.

The proportion of the accelerating agent to be blended may be properly determined depending on the type of the accelerating agent, but is preferably not less than 0.1 part by mass and not greater than 5 parts by mass, particularly preferably not less than 0.2 parts by mass and not greater than 2 parts by mass, based on 100 parts by mass of the overall rubber component.

Examples of the acceleration assisting agent include: metal compounds such as zinc white; fatty acids such as stearic acid, oleic acid and cotton seed fatty acids; and other conventionally known acceleration assisting agents, which may be used either alone or in combination.

The proportion of the acceleration assisting agent to be blended is preferably not less than 0.1 part by mass and not greater than 7 parts by mass, particularly preferably not less than 0.5 parts by mass and not greater than 5 parts by mass, based on 100 parts by mass of the overall rubber component.

<Other Ingredients>

As required, various additives may be added to the rubber composition. Examples of the additives include an acid accepting agent, a plasticizing agent, a processing aid, a degradation preventing agent, a filler, an anti-scorching agent, a lubricant, a pigment, an anti-static agent, a flame retarder, a neutralizing agent, a nucleating agent, a co-crosslinking agent and the like.

In the presence of the acid accepting agent, chlorine-containing gases generated from the epichlorohydrin rubber and the CR during the crosslinking of the rubber component are prevented from remaining in the base layer 4. Thus, the acid accepting agent functions to prevent the inhibition of the crosslinking and the contamination of the photoreceptor body, which may otherwise be caused by the chlorine-containing gases.

Any of various substances serving as acid acceptors may be used as the acid accepting agent. Preferred examples of the acid accepting agent include hydrotalcites and Magsarat which are excellent in dispersibility. Particularly, the hydrotalcites are preferred.

Where the hydrotalcites are used in combination with magnesium oxide or potassium oxide, a higher acid accepting effect can be provided, thereby more reliably preventing the contamination of the photo receptor body.

The proportion of the acid accepting agent to be blended is preferably not less than 0.5 parts by mass and not greater than 6 parts by mass, particularly preferably not less than 1 part by mass and not greater than 4 parts by mass, based on 100 parts by mass of the overall rubber component.

Examples of the plasticizing agent include plasticizers such as dibutyl phthalate (DBP), dioctyl phthalate (DOP) and tricresyl phosphate, and waxes such as polar waxes. Examples of the processing aid include fatty acids such as stearic acid.

The proportion of the plasticizing agent and/or the processing aid to be blended is preferably not greater than 5 parts by mass based on 100 parts by mass of the overall rubber component. This prevents the contamination of the photoreceptor body, for example, when the electroconductive roller is mounted in the image forming apparatus or when the image forming apparatus is operated. For this purpose, it is particularly preferred to use any of the polar waxes out of the plasticizing agents.

Examples of the degradation preventing agent include various anti-aging agents and anti-oxidants.

The anti-oxidants serve to reduce the environmental dependence of the roller resistance of the electroconductive roller and to suppress the increase in roller resistance during continuous energization of the electroconductive roller. Examples of the anti-oxidants include nickel diethyldithiocarbamate (NOCRAC (registered trade name) NEC-P available from Ouchi Shinko Chemical Industrial Co., Ltd.) and nickel dibutyldithiocarbamate (NOCRAC NBC available from Ouchi Shinko Chemical Industrial Co., Ltd.)

Examples of the filler include zinc oxide, silica, carbon, carbon black, clay, talc, calcium carbonate, magnesium carbonate and aluminum hydroxide, which may be used either alone or in combination.

The mechanical strength and the like of the base layer 4 can be improved by blending the filler.

The proportion of the filler to be blended is preferably not less than 5 parts by mass and not greater than 25 parts by mass, particularly preferably not greater than 20 parts by mass, based on 100 parts by mass of the overall rubber component.

An electron conductive agent (electrically conductive filler) such as electrically conductive carbon black may be blended as the filler to impart the base layer 4 with electron conductivity.

Preferred examples of the electrically conductive carbon black include DENKA BLACK (registered trade name) available from Denki Kagaku Kogyo K.K., and KETJEN BLACK (registered trade name) EC300J available from Lion Corporation, which may be used either alone or in combination.

The proportion of the electrically conductive carbon black to be blended is preferably not less than 1 part by mass and not greater than 10 parts by mass, based on 100 parts by mass of the overall rubber component.

Examples of the anti-scorching agent include N-cyclohexylthiophthalimide, phthalic anhydride, N-nitrosodiphenylamine and 2,4-diphenyl-4-methyl-1-pentene, which may be used either alone or in combination. Particularly, N-cyclohexylthiophthalimide is preferred.

The proportion of the anti-scorching agent to be blended is preferably not less than 0.1 part by mass and not greater than 5 parts by mass, particularly preferably not greater than 1 part by mass, based on 100 parts by mass of the overall rubber component.

The co-crosslinking agent serves to crosslink itself as well as the rubber component to increase the overall molecular weight.

Examples of the co-crosslinking agent include ethylenically unsaturated monomers typified by methacrylic esters, metal salts of methacrylic acid and acrylic acid, polyfunctional polymers utilizing functional groups of 1,2-polybutadienes, and dioximes, which may be used either alone or in combination.

Examples of the ethylenically unsaturated monomers include:

(a) monocarboxylic acids such as acrylic acid, methacrylic acid and crotonic acid;
(b) dicarboxylic acids such as maleic acid, fumaric acid and itaconic acid;
(c) esters and anhydrides of the unsaturated carboxylic acids (a) and (b);
(d) metal salts of the monomers (a) to (c);
(e) aliphatic conjugated dienes such as 1,3-butadiene, isoprene and 2-chloro-1,3-butadiene;
(f) aromatic vinyl compounds such as styrene, α-methylstyrene, vinyltoluene, ethylvinylbenzene and divinylbenzene;
(g) vinyl compounds such as triallyl isocyanurate, triallyl cyanurate and vinylpyridine each having a hetero ring; and
(h) cyanovinyl compounds such as (meth)acrylonitrile and α-chloroacrylonitrile, acrolein, formyl sterol, vinyl methyl ketone, vinyl ethyl ketone and vinyl butyl ketone.

These ethylenically unsaturated monomers may be used either alone or in combination.

Monocarboxylic acid esters are preferred as the esters (c) of the unsaturated carboxylic acids.

Specific examples of the monocarboxylic acid esters include:

alkyl (meth)acrylates such as methyl (meth)acrylate, ethyl (meth)acrylate, n-propyl (meth)acrylate, i-propyl (meth) acrylate, n-butyl (meth)acrylate, i-butyl (meth)acrylate, n-pentyl (meth)acrylate, i-pentyl (meth)acrylate, n-hexyl (meth)acrylate, cyclohexyl (meth)acrylate, 2-ethylhexyl (meth)acrylate, octyl (meth)acrylate, i-nonyl (meth)acrylate, tert-butylcyclohexyl (meth)acrylate, decyl (meth)acrylate, dodecyl (meth)acrylate, hydroxymethyl (meth)acrylate and hydroxyethyl (meth)acrylate;

aminoalkyl (meth)acrylates such as aminoethyl (meth) acrylate, dimethylaminoethyl (meth)acrylate and butylaminoethyl (meth)acrylate;

(meth)acrylates such as benzyl (meth)acrylate, benzoyl (meth)acrylate and aryl (meth)acrylates each having an aromatic ring;

(meth)acrylates such as glycidyl (meth)acrylate, methaglycidyl (meth)acrylate and epoxycyclohexyl (meth)acrylate each having an epoxy group;

(meth)acrylates such as N-methylol (meth) acrylamide, γ-(meth)acryloxypropyltrimethoxysilane and tetrahydrofurfuryl methacrylate each having a functional group; and polyfunctional (meth)acrylates such as ethylene glycol di(meth)acrylate, trimethylolpropane tri(meth)acrylate, ethylene dimethacrylate (EDMA), polyethylene glycol dimethacrylate and isobutylene ethylene dimethacrylate. These monocarboxylic acid esters may be used either alone or in combination.

<Rubber Composition>

The rubber composition containing the ingredients described above can be prepared in a conventional manner. First, the rubbers for the rubber component are blended in the predetermined proportions, and the resulting rubber component is simply kneaded. After additives other than the crosslinking component are added to and kneaded with the rubber component, the crosslinking component is finally added to and further kneaded with the resulting mixture. Thus, the rubber composition is provided. A kneader, a Banbury mixer, an extruder or the like, for example, is usable for the kneading.

<Formation of Base Layer 4>

The base layer 4 is formed by first extruding the aforementioned rubber composition into a tubular body by means of an extruder, then cutting the tubular body to a predetermined length, and crosslinking the resulting tubular body in a vulcanization can by pressure and heat.

In turn, the crosslinked tubular body is heated in an oven or the like for secondary crosslinking, then cooled, and polished to a predetermined outer diameter. Thus, the base layer 4 is formed.

The roller resistance $R_1$ (Ω) of the base layer 4 is controlled to fall within the range defined by the expression (2) by variably setting the type and the proportion of the ion conductive rubber such as the epichlorohydrin rubber described above or, when the electrically conductive carbon black is blended in the rubber composition, by variably setting the type and the proportion of the electrically conductive carbon black.

The base layer 4 may be controlled to have a desired hardness and a desired compressive permanent set. The hardness and the compressive permanent set of the base layer 4 may be controlled, for example, by controlling the type and the amount of the rubber component, the type and the amount of the crosslinking component, and the types and the amounts of the filler and other ingredients.

The thickness of the base layer 4 may be properly determined depending on the construction and the size of an image forming apparatus in which the electroconductive roller 1 is to be incorporated.

The base layer 4 is preferably formed as having a nonporous single-layer structure for simplification of the structure and improvement of the durability.

<<Surface Layer 6>>

The surface layer 6 is formed from a material prepared, for example, by blending an electrically conductive agent in a binder resin in order to satisfy the aforementioned expressions (1) to (3) defined with respect to the base layer 4 made of the ion-conductive elastic material.

An electron conductive agent such as carbon or graphite is preferably used as the electrically conductive agent. Particularly, carbon having an iodine adsorption amount of not less than 80 mg/g and an oil adsorption amount of not less than 60 ml/100 g is preferred.

The iodine adsorption amount and the oil adsorption amount of the carbon are limited to the aforementioned ranges for the following reasons:

If the carbon has an iodine adsorption amount of less than 80 mg/g, it will be impossible to impart the surface layer 6 with a higher electrical conductivity satisfying the surface resistance $R_2$ (Ω) defined by the expression (3). If a greater amount of the carbon is blended in the binder resin to impart the surface layer 6 with a higher electrical conductivity, the surface layer 6 is liable to have a higher hardness or have a reduced film strength.

If the carbon has an oil adsorption amount of less than 60 ml/g, it will be impossible to impart the surface layer 6 with a higher electrical conductivity satisfying the surface resistance $R_2$ (Ω) defined by the expression (3). If a greater amount of the carbon is blended in the binder resin to impart the surface layer 6 with a higher electrical conductivity, the surface layer 6 is liable to have a higher hardness or have a reduced film strength.

The proportion of the carbon or the graphite to be blended is preferably not less than 60 mass % based on the mass of solids in the surface layer 6.

If the proportion of the carbon or the graphite is less than the aforementioned range, it will be impossible to impart the surface layer 6 with a higher electrical conductivity satisfying the surface resistance $R_2$ (Ω) defined by the aforementioned expressions (1) to (3), particularly by the expression (3).

If the proportion of the carbon or the graphite is excessively great, the surface layer 6 is liable to have a reduced film strength. Therefore, the proportion of the carbon or the graphite to be blended is preferably not greater than 70 mass % based on the mass of the solids in the aforementioned range.

The binder resin to be used in combination with the carbon or the graphite for the formation of the surface layer 6 may be any of various binder resins which permits proper dispersion of the carbon or the graphite and proper adhesion to the outer peripheral surface 5 of the base layer 4 formed from the rubber composition described above.

Examples of the binder resin include urethane resins, rubbers, vinyl resins and other binder resins.

The surface layer 6 is formed by dissolving or dispersing the electrically conductive agent such as the carbon or the graphite and the binder resin in a given solvent to prepare a coating material, applying the coating material on the outer peripheral surface 5 of the base layer 4 by a given coating method such as a spraying method, drying the resulting coating film and, where the binder resin is curable, curing the coating film.

The coating material preferably has a viscosity of not higher than 1.0 Pa·s (at 23° C.). If the viscosity is higher than this range, it will be difficult to form a surface layer 6 having a uniform thickness on the outer peripheral surface 5 of the base layer 4.

The surface layer 6 preferably has a thickness of not less than 1 μm in order to function as the conductor as described above to reduce the resistance of the overall electroconductive roller 1.

If the thickness is excessively great, the surface layer 6 is liable to have a higher hardness to reduce the flexibility of the overall electroconductive roller 1, or liable to be separated from the base layer 4. The thickness of the surface layer 6 is preferably not greater than 100 μm in the aforementioned range.

In order to control the surface resistance $R_2$ (Ω) of the outer peripheral surface 7 of the surface layer 6 in the range defined by the expression (3), the proportion of the carbon or the graphite based on the amount of the solids in the surface layer 6 may be properly adjusted, or the type of the carbon or the graphite to be blended or the type of the binder resin may be properly selected.

<<Roller Resistance Measuring Method>>

Figure 3:
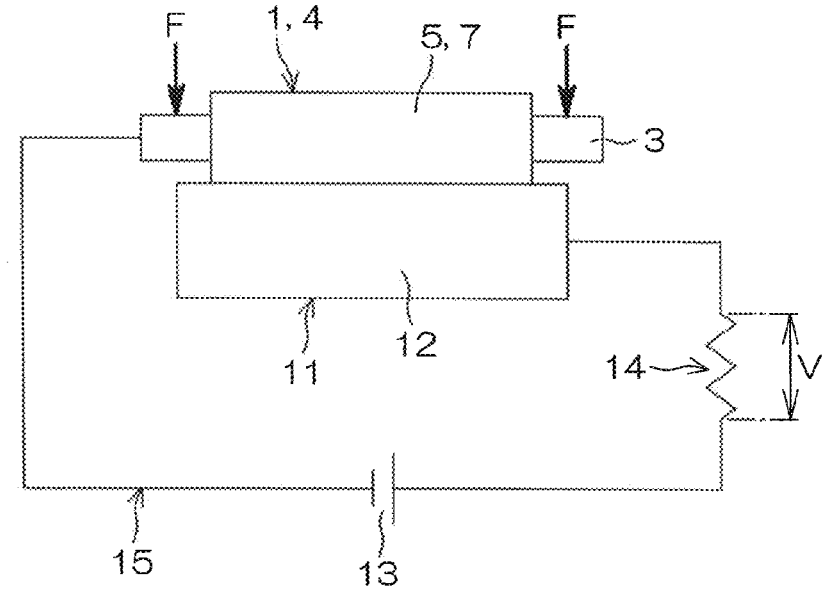
FIG. 3 is a diagram for explaining a method for measuring the roller resistance of a base layer of the electroconductive roller and the roller resistance of the overall electroconductive roller.

FIG. 3 is a diagram for explaining a method for measuring the roller resistances of the base layer 4 and the overall electroconductive roller 1.

Referring to FIGS. 1 and 3, the roller resistance $R_1$ (Ω) of the base layer 4 and the roller resistance $R_3$ (Ω) of the overall electroconductive roller 1 are measured in an ordinary temperature and ordinary humidity environment at a temperature of 23° C. at a relative humidity of 55% with an application voltage of 100 V by the following method in the present invention.

More specifically, an aluminum drum 11 rotatable at a constant rotation speed is prepared, and the outer peripheral surface 5 of the base layer 4 or the outer peripheral surface 7 of the electroconductive roller 1 is brought into contact with an outer peripheral surface 12 of the aluminum drum 11 from above with the shaft 3 preliminarily inserted through and fixed to the base layer 4.

A DC power source 13 and a resistor 14 are connected in series between the shaft 3 and the aluminum drum 11 to provide a measurement circuit 15. The DC power source 13 is connected to the shaft 3 at its negative terminal, and connected to the resistor 14 at its positive terminal. The resistor 14 has a resistance r of 100 Ω.

Subsequently, a load F of 500 g is applied to opposite end portions of the shaft 3 to bring the outer peripheral surface 5 of the base layer 4 or the outer peripheral surface 7 of the electroconductive roller 1 into press contact with the aluminum drum 11 and, in this state, a detection voltage V applied to the resistor 14 is measured ten times in 4 seconds by applying an application voltage E of DC 100 V from the DC power source 13 between the shaft 3 and the aluminum drum 11 while rotating the aluminum drum 11 (at a rotation speed of 30 rpm). Then, the detection voltages V thus measured are averaged.

The roller resistance $R_1$ (Ω) of the base layer 4 and the roller resistance $R_3$ (Ω) of the electroconductive roller 1 are each basically calculated from the following expression (1') based on the average detection voltage V and the application voltage E (=100 V):

$$R=r\times E/(V-r) \quad (1')$$

However, the term −r of the expression (1') is negligible, so that the roller resistance $R_1$ (Ω) of the base layer 4 and the roller resistance $R_3$ (Ω) of the electroconductive roller 1 are each calculated from the following expression (1) in the present invention:

$$R=r\times E/V \quad (1)$$

<<Surface Resistance Measuring Method>>

In the present invention, the surface resistance $R_2$ (Ω) of the outer peripheral surface 7 of the surface layer 6 is measured in a surface resistance measuring mode with the use of a resistivity meter LORESTA (registered trade name) GP MCP-T610 and an ESP probe available from Mitsubishi Chemical Analytech Co., Ltd. in an ordinary temperature and ordinary humidity environment at a temperature of 23° C. at a relative humidity of 55%.

More specifically, the thickness of the surface layer 6 preliminarily determined and RCF=4532 are inputted in the resistivity meter and, with a limit voltage set at 10 V, the ESP probe is pressed against the outer peripheral surface 7 of the surface layer 6. After a lapse of 10 seconds, the surface resistance $R_2$ (Ω) of the outer peripheral surface 7 of the surface layer 6 is measured.

The thickness of the surface layer 6 is determined, for example, through observation by means of a scanning electron microscope or based on a difference between masses measured before and after the formation of the surface layer 6.

The inventive electroconductive roller may be used not only as the charging roller but also as a developing roller, a transfer roller, a cleaning roller or the like, for example, in an electrophotographic image forming apparatus.

<<Image Forming Apparatus>>

The inventive image forming apparatus incorporates the inventive electroconductive roller as the charging roller.

Examples of the inventive image forming apparatus include various electrophotographic image forming apparatuses such as a laser printer, an electrostatic copying machine, a plain paper facsimile machine and a printer-copier-facsimile multifunction machine.

EXAMPLES

<Base Layer I>

(Rubber Composition)

A rubber component was prepared by blending 40 parts by mass of a GECO ((EPION (registered trade name) 301L available from Daiso Co., Ltd. and having a molar ratio of EO/EP/AGE=73/23/4), 30 parts by mass of a CR (SHOPRENE (registered trade name) WRT available from Showa Denko K.K.) and 30 parts by mass of an NBR (lower acrylonitrile content NBR JSR N250 SL available from JSR Co., Ltd. and having an acrylonitrile content of 20%).

While 100 parts by mass of the rubber component was simply kneaded by means of a Banbury mixer, ingredients shown below in Table 1 except the crosslinking component were added to the rubber component. After the resulting mixture was further kneaded, the crosslinking component was added to and further kneaded with the mixture. Thus, a rubber composition was prepared.

TABLE 1

| Ingredients | Parts by mass |
|---|---|
| 5% Oil-containing sulfur | 1.20 |
| Thiourea crosslinking agent | 0.50 |
| Accelerating agent MBTS | 0.20 |
| Accelerating agent TS | 0.50 |
| Accelerating agent DT | 0.43 |
| Zinc oxide type-2 | 5.00 |
| Carbon black A | 2.00 |
| Carbon black B | 5.00 |
| Acid accepting agent | 3.00 |

The ingredients shown in Table 1 are as follows. The amounts (parts by mass) shown in Table 1 are based on 100 parts by mass of the overall rubber component. 5% Oil-containing sulfur: Crosslinking agent available from Tsurumi Chemical Industry Co., Ltd. Thiourea crosslinking agent: Ethylene thiourea (2-mercaptoimidazoline) ACCEL (registered trade name) 22-S available from Kawaguchi Chemical Industry Co., Ltd. Accelerating agent METS:

Di-2-benzothiazolyl disulfide (thiazole accelerating agent) NOCCELER (registered trade name) DM-P available from Ouchi Shinko Chemical Industrial Co., Ltd.

Accelerating agent TS: Tetramethylthiuram monosulfide (thiuram accelerating agent) SANCELER (registered trade name) TS available from Sanshin Chemical Industry Co., Ltd.

Accelerating agent DT: 1,3-di-o-tolylguanidine (guanidine accelerating agent) SANCELER DT available from Sanshin Chemical Industry Co., Ltd.

Zinc oxide Type-2: Acceleration assisting agent available from Sakai Chemical Industry Co., Ltd.

Carbon black A: Particulate electrically conductive carbon black DENKA BLACK (registered trade name) available from Denki Kagaku Kogyo K.K.

Carbon black B: Carbon black filler #15 (FT) available from Asahi Carbon Co., Ltd.

Acid accepting agent: Hydrotalcites (DHT-4A (registered trade name) 2 available from Kyowa Chemical Industry Co., Ltd.)

(Production of Base Layer)

The rubber composition thus prepared was fed into an extruder, and extruded into a tubular body having an outer diameter of 20.0 mm and an inner diameter of 7.0 mm. Then, the tubular body was fitted around a temporary crosslinking shaft, and crosslinked in a vulcanization can at 160° C. for 1 hour.

Subsequently, the crosslinked tubular body was removed from the temporary shaft, then fitted around a shaft having an outer diameter of 7.5 mm and an outer peripheral surface to which an electrically conductive thermosetting adhesive agent was applied, and heated in an oven at 160° C. Thus, the tubular body was bonded to the shaft. In turn, opposite end portions of the tubular body were cut, and the outer peripheral surface of the resulting tubular body was polished by a traverse polishing method by means of a cylindrical polishing machine. Then, the outer peripheral surface was mirror-polished as having an outer diameter of 16.00 mm (with a tolerance of 0.05), and rinsed with water. Thus, a base layer I unified with the shaft was produced.

The roller resistance $R_1$ (Ω) of the base layer I thus produced was measured with an application voltage of 100 V by the aforementioned measuring method and, as a result, expressed as log $R_1$=6.82.

<Base Layer II>

A rubber composition for a base layer II was prepared in substantially the same manner as the rubber composition for the base layer I, except that a rubber component was prepared by blending 70 parts by mass of the GECO, 10 parts by mass of the CR and 20 parts by mass of the NBR. Then, the base layer II was produced from the thus prepared rubber composition in the same manner as the base layer I as having the same shape and the same size as the base layer I and unified with the shaft.

The roller resistance $R_1$ (Ω) of the base layer II thus produced was measured with an application voltage of 100 V by the aforementioned measuring method and, as a result, expressed as log $R_1$=5.69.

<Base Layer III>

A rubber composition for a base layer III was prepared in substantially the same manner as the rubber composition for the base layer I, except that a rubber component was prepared by blending 10 parts by mass of the GECO, 10 parts by mass of the CR and 80 parts by mass of the NBR, and 10 parts by mass of carbon black C (electrically conductive carbon black KETJEN BLACK (registered trade name) EC300J available from Lion Corporation) based on 100 parts by mass of the overall rubber component was used instead of carbon black A and carbon black B. Then, the base layer III was produced from the thus prepared rubber composition in the same manner as the base layer I as having the same shape and the same size as the base layer I and unified with the shaft.

The roller resistance $R_1$ (Ω) of the base layer III thus produced was measured with an application voltage of 100 V by the aforementioned measuring method and, as a result, expressed as log $R_1$=5.78.

<Base Layer IV>

A rubber composition for a base layer IV was prepared in substantially the same manner as the rubber composition for the base layer I, except that a rubber component was prepared by blending 10 parts by mass of the GECO, 10 parts by mass of the CR and 80 parts by mass of the NBR. Then, the base layer IV was produced from the thus prepared rubber composition in the same manner as the base layer I as having the same shape and the same size as the base layer I and unified with the shaft.

The roller resistance $R_1$ (Ω) of the base layer IV thus produced was measured with an application voltage of 100 V by the aforementioned measuring method and, as a result, expressed as log $R_1$=8.33.

<Surface Layer i>

An aqueous urethane resin-based coating material (SUIKEI-1 available from Kuretake Co., Ltd., and having a solid amount of 11.2 mass % and a viscosity of $6.4\times10^{-3}$ Pa·s) in which carbon having an iodine adsorption amount of 133 mg/g and an oil adsorption amount of 220 ml/100 g was contained in a proportion of 66.9 mass % on a solid basis was used as a coating material for the surface layer. The coating material was sprayed on the outer peripheral surfaces of predetermined ones of the base layers, then naturally dried for 30 minutes, and further dried at 100° C. for 1 hour. Thus, a surface layer i was formed.

The surface resistance $R_2$ (Ω) of the surface layer i thus formed was measured by the aforementioned measuring method and, as a result, expressed as log $R_2$=3.00.

<Surface Layer ii>

A surface layer ii was formed on the outer peripheral surfaces of predetermined ones of the base layers in substantially the same manner as the surface layer i, except that a rubber-based coating material (VARNIPHITE UCC-2 available from Nippon Graphite Industries, Ltd. and having a solid amount of 19.34 mass % and a viscosity of 0.6 Pa·s) in which graphite was contained in a proportion of 67.7 mass % on a solid basis was used as a coating material for the surface layer.

The surface resistance $R_2$ (Ω) of the surface layer ii thus formed was measured by the aforementioned measuring method and, as a result, expressed as log $R_2$=1.50.

<Surface Layer iii>

A surface layer iii was formed on the outer peripheral surfaces of predetermined ones of the base layers in substantially the same manner as the surface layer i, except that a vinyl resin-based coating material (VARNIPHITE #27 available from Nippon Graphite Industries, Ltd. and having a solid amount of 31.65 mass % and a viscosity of 0.3 Pa·s) in which graphite was contained in a proportion of 62.2 mass % on a solid basis was used as a coating material for the surface layer.

The surface resistance $R_2$ (Ω) of the surface layer iii thus formed was measured by the aforementioned measuring method and, as a result, expressed as log $R_2$=2.03.

<Surface Layer iv>

A surface layer iv was formed on the outer peripheral surfaces of predetermined ones of the base layers in substantially the same manner as the surface layer i, except that a urethane resin-based coating material (JLY009 available from Henkel Japan Co., Ltd. and having a solid amount of 25.1 mass % and a viscosity of 0.2 Pa·s) containing neither carbon nor graphite was used as a coating material for the surface layer.

The surface resistance $R_2$ (Ω) of the surface layer iv thus formed was measured by the aforementioned measuring method and, as a result, expressed as log $R_2$=8.19.

Examples 1 to 6 and Comparative Examples 1 to 6

Electroconductive rollers of Examples 1 to 6 and Comparative Examples 1 to 6 were produced by employing the base layers I to IV in combination with the surface layers i to iv as shown in Tables 2 and 3.

The roller resistance $R_3$ (Ω) of each of the overall electroconductive rollers thus produced was measured with an application voltage of 100 V by the aforementioned measuring method.

Further, the roller resistance $R_4$ (Ω) of each of the overall electroconductive rollers was measured with an application voltage of 10 V by the aforementioned measuring method. Then, a difference was calculated from the following expression (5):

$$R_v = \log R_4 - \log R_3 \quad (5)$$

Based on the difference, the electroconductive rollers were each evaluated for the voltage dependence of the roller resistance. A smaller difference $R_v$ indicates that the voltage dependence is smaller and the roller resistance of the electroconductive roller is more stable.

Further, a difference log $R_1$−log $R_2$ was calculated based on the roller resistance $R_1$ (Ω) of the base layer and the surface resistance $R_2$ (Ω) of the surface layer employed in combination with the base layer. Based on the roller resistance $R_1$ (Ω) of the base layer and the roller resistance $R_3$ (Ω) of the overall electroconductive roller, a change in roller resistance due to the provision of the surface layer was calculated from the following expression (6):

$$\Delta R = \log R_1 - \log R_3 \quad (6)$$

A positive value of the change indicates that the roller resistance was reduced, and a negative value of the change indicates that the roller resistance was increased.

The above results are shown in Tables 2 and 3.

TABLE 2

| | Example | | | | | |
|---|---|---|---|---|---|---|
| | 1 | 2 | 3 | 4 | 5 | 6 |
| Base layer | | | | | | |
| Type | I | I | I | II | II | II |
| log $R_1$ | 6.82 | 6.82 | 6.82 | 5.69 | 5.69 | 5.69 |
| Surface layer | | | | | | |
| Type | i | ii | iii | i | ii | iii |
| log $R_2$ | 3.00 | 1.50 | 2.03 | 3.00 | 1.50 | 2.03 |
| log $R_1$ − log $R_2$ | 3.82 | 5.32 | 4.79 | 2.69 | 4.19 | 3.66 |
| Overall electroconductive roller | | | | | | |
| log $R_3$ (100 V) | 4.59 | 4.56 | 4.59 | 3.82 | 3.80 | 3.82 |
| log $R_4$ (10 V) | 4.63 | 4.61 | 4.63 | 3.88 | 3.86 | 3.88 |
| Voltage dependence $R_v$ | 0.04 | 0.05 | 0.04 | 0.06 | 0.06 | 0.06 |
| Roller resistance ΔR | 2.23 | 2.26 | 2.23 | 1.87 | 1.89 | 1.87 |

TABLE 3

| | Comparative Example | | | | | |
|---|---|---|---|---|---|---|
| | 1 | 2 | 3 | 4 | 5 | 6 |
| Base layer | | | | | | |
| Type | IV | IV | IV | IV | I | III |
| log $R_1$ | 8.33 | 8.33 | 8.33 | 8.33 | 6.82 | 5.78 |
| Surface layer | | | | | | |
| Type | i | ii | iii | iv | iv | — |
| log $R_2$ | 3.00 | 1.50 | 2.03 | 8.19 | 8.19 | — |
| log $R_1$ − log $R_2$ | 5.33 | 6.83 | 6.30 | 0.14 | −1.37 | — |
| Overall electroconductive roller | | | | | | |
| log $R_3$ (100 V) | 5.11 | 5.22 | 5.12 | 8.28 | 7.80 | 5.78 |
| log $R_4$ (10 V) | 5.16 | 5.25 | 5.16 | 8.33 | 7.84 | 6.76 |
| Voltage dependence $R_v$ | 0.05 | 0.03 | 0.04 | 0.05 | 0.04 | 0.98 |
| Roller resistance ΔR | 3.22 | 3.11 | 3.21 | 0.05 | −0.98 | — |

The results for Examples 1 to 6 and Comparative Examples 1 to 6 in Tables 2 and 3 indicate that, where the roller resistance $R_1$ (Ω) of the base layer is log $R_1 \leq 7.0$ and the surface resistance $R_2$ (Ω) of the outer peripheral surface of the surface layer is log $R_2 \leq 4.0$ and the difference between these resistances is log $R_1$−log $R_2 \geq 2.5$, the roller resistance $R_3$ (Ω) of the overall electroconductive roller can be reduced to log $R_3 \leq 4.7$, and the voltage dependence of the roller resistance can be reduced by the layered structure to stabilize the roller resistance of the electroconductive roller.

The results for Examples 1 to 6 in Table 2 indicate that the roller resistance $R_1$ (Ω) of the base layer is preferably $5.5 \leq \log R_1 \leq 6.0$.

Further, the results for Examples 1 to 6 indicate that the surface resistance $R_2$ (Ω) of the outer peripheral surface of the surface layer is preferably $1.0 \leq \log R_2$.

<<Potential Distribution>>

The potential distributions of the electroconductive rollers of Example 4 and Comparative Example 4 were each determined through simulation in which a 100-V electrode was kept in contact with the outer peripheral surface at a single point and the shaft was kept at 0 V. The results for Example 4 and Comparative Example 4 are shown in FIGS. 4(*a*) and 4(*b*), respectively.

FIG. 4(*b*) indicates that, in the electroconductive roller of Comparative Example 4 having the conventional single layer structure, the electric current path is a shortest linear region connecting the electrode located at (x,y)=(0,−0.8) to the shaft (a white round region in FIG. 4 (*b*)) and, hence, has a very small sectional area.

In contrast, FIG. 4(*a*) indicates that, in the electroconductive roller of Example 4 configured such that the surface layer is provided on the outer peripheral surface of the base layer and the resistances of the surface layer and the base layer satisfy all the expressions (1) to (3) according to the present invention, the entire surface layer functions as the circumferential electric current path connected to the shaft and, hence, the electric current path has a significantly increased sectional area.

This application corresponds to Japanese Patent Application No. 2014-162999 filed in the Japan Patent Office on Aug. 8, 2014, the disclosure of which is incorporated herein by reference in its entirety.

What is claimed is:

1. An electroconductive roller comprising:

a tubular body made of an ion-conductive elastic material, which has an outer peripheral surface, an inner peripheral surface, and a base layer formed between the outer peripheral surface and the inner peripheral surface; and a surface layer provided on an outer peripheral surface of the tubular layer;

wherein the base layer has a roller resistance $R_1$ (Ω), which is a resistance value of the base layer between a press-contacted portion of the outer peripheral surface of the tubular body being brought into press-contact with a conductive drum and being rotated therewith and the inner peripheral surface of the tubular body, and the surface layer has a surface resistance $R_2$ (Ω), wherein the roller resistance $R_1$ (Ω) and the surface resistance $R_2$ (Ω), both measured in the radial direction, satisfy all the following expressions (1) to (3):

$$\log R_1 - \log R_2 \geq 2.5 \quad (1)$$

$$\log R_1 \leq 7.0 \quad (2)$$

$$\log R_2 \leq 4.0 \quad (3),$$

wherein the surface layer is a surface layer formed by applying a coating material having a viscosity of not greater than 1.0 Pa·s on the outer peripheral surface of the base layer, the coating material comprising not less than 60 mass % of carbon based on the mass of solids in the surface layer, the carbon having an iodine adsorption amount of not less than 80 mg/g and an oil adsorption amount of not less than 60 ml/100 g.

2. The electroconductive roller according to claim 1, which the electroconductive roller has a roller resistance $R_3$ (Ω), which is a total resistance value of the surface layer and the base layer between a press-contacted portion of the surface layer being brought into press-contact with a conductive drum and being rotated therewith and the inner peripheral surface of the tubular body, wherein the roller resistance $R_3$ (Ω), measured in the radial direction, satisfies the following expression (4):

$$\log R_3 \leq 4.7 \quad (4).$$

3. The electroconductive roller according to claim 2, wherein the base layer is a base layer formed from an ion conductive rubber composition which comprises a rubber component including an epichlorohydrin rubber and a diene rubber.

4. The electroconductive roller according to claim 3, wherein the surface layer is a surface layer formed by applying a coating material having a viscosity of not greater than 1.0 Pa·s on the outer peripheral surface of the base layer, the coating material comprising not less than 60 mass % of carbon based on the mass of solids in the surface layer, the carbon having an iodine adsorption amount of not less than 80 mg/g and an oil adsorption amount of not less than 60 ml/100 g.

5. An image forming apparatus which incorporates the electroconductive roller according to claim 4 as a charging roller.

6. The electroconductive roller according to claim 1, wherein the base layer is a base layer formed from an ion conductive rubber composition which comprises a rubber component including an epichlorohydrin rubber and a diene rubber.

7. An image forming apparatus which incorporates the electroconductive roller according to claim 1 as a charging roller.

* * * * *